US005906692A

United States Patent [19]

Bhowal et al.

[11] Patent Number: 5,906,692

[45] Date of Patent: May 25, 1999

[54] PROCESS FOR PRODUCING FORGED α-2 BASED TITANIUM ALUMINIDES HAVING FINE GRAINED AND ORTHORHOMBIC TRANSFORMED MICROSTRUCTURE AND ARTICLES MADE THEREFROM

[75] Inventors: Prabir Ranjan Bhowal, Huntington, Conn.; William A. Konkel, Bellaire, Tex.

[73] Assignee: AlliedSignal Inc., Morris Township, N.J.

[21] Appl. No.: 08/705,081

[22] Filed: Aug. 29, 1996

Related U.S. Application Data

[63] Continuation of application No. 08/362,132, Dec. 22, 1994, abandoned, which is a continuation-in-part of application No. 08/174,394, Dec. 28, 1993, abandoned.

[51] Int. Cl.[6] ..... C22F 1/18

[52] U.S. Cl. ..... 148/671; 148/670

[58] Field of Search ..... 148/670, 671

[56] References Cited

U.S. PATENT DOCUMENTS 5,185,045 2/1993 Peters et al. ..... 148/671

5,190,603 3/1993 Nazmy et al. ..... 148/671

5,281,285 1/1994 Marquardt ..... 148/670

*Primary Examiner*—John Sheehan

*Attorney, Agent, or Firm*—Jerry J. Holden

[57] ABSTRACT

Process for improving the mechanical properties and ultrasonic inspection efficiency of alpha-2 titanium aluminide forged products, parts or components and for preserving or retaining these improved properties at use temperatures up to about 1200° F. The process involves heating a billet of the alloy below its beta transus temperature, forging the heated billet within a true strain range of about 1.2 and 1.4 and within a strain rate of about 0.1 and 0.15 per second to produce >90% refinement of prior β grains to a typical size less than about 0.2 mm, preferably about 0.02 mm, and cooling the forged billet to room temperature. A heat-treatment may be applied by rapidly cooling to room temperature to form the transformed beta phase with no precipitation of alpha platelets, and then heating to a transformation temperature (T) for a period of time (t) to form a beneficial orthorhombic crystalline phase microstructure including very fine alpha-2 particles, and not heating the alloy again above the use temperature of 1200° F., whereby the beneficial microstructure is retained and remains stable for extended periods of exposure at or below 1200° F.

6 Claims, 8 Drawing Sheets

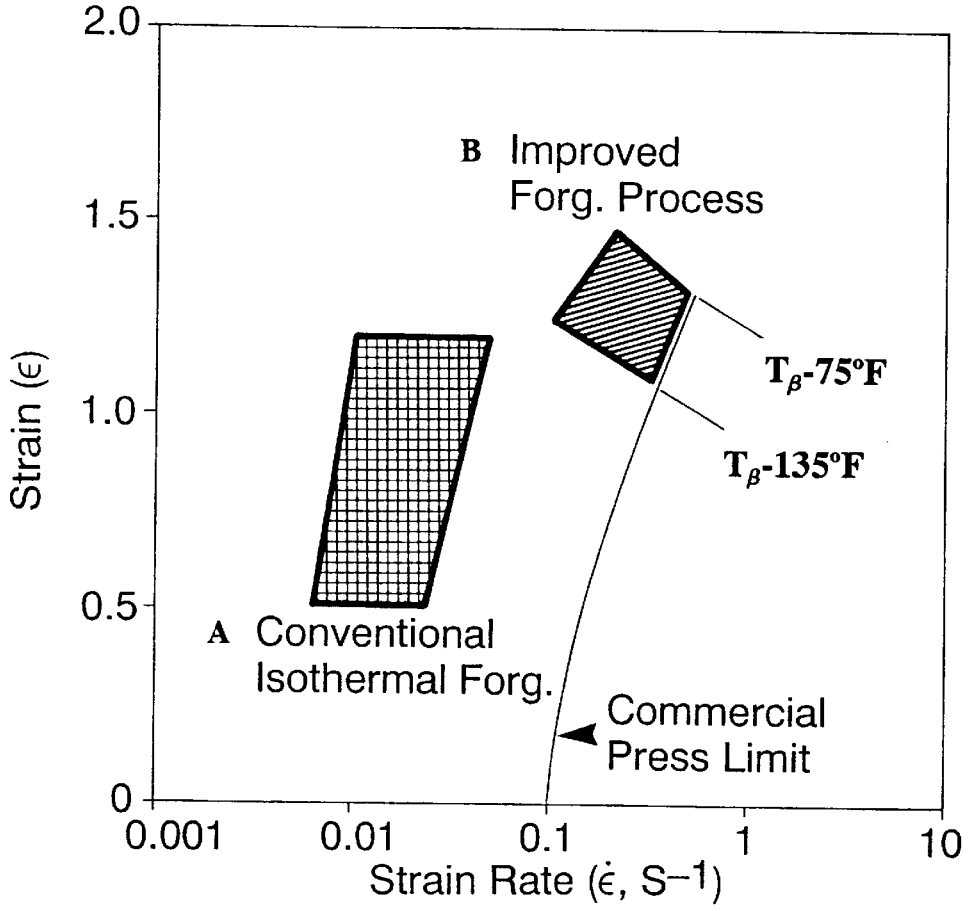
Figure 1: Illustration of the deformation parameters in the conventional isothermal forging process (A) and fine-grain forging process of the present invention (B)

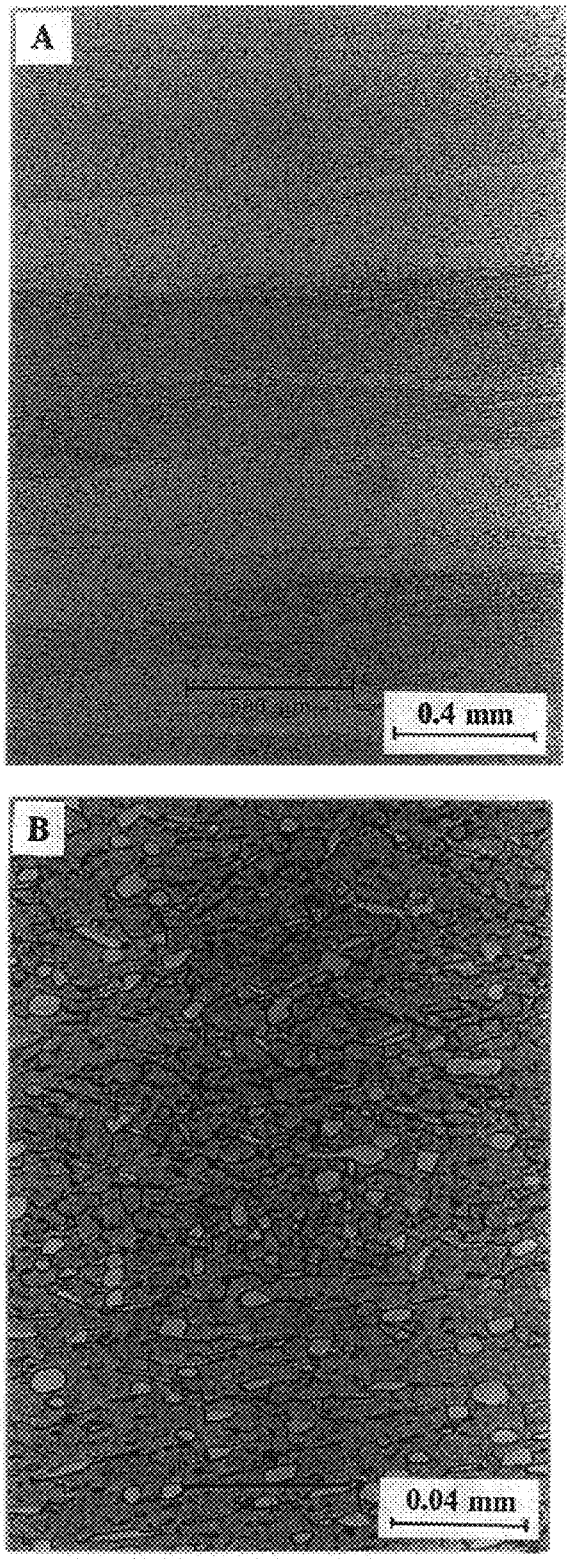
Figure 2: Illustration of β grain size in the microstructure of (A) conventional forging (Grain size ~0.5mm x 3.0mm) and (B) fine-grain forging (Grain size ~0.02mm) of present invention

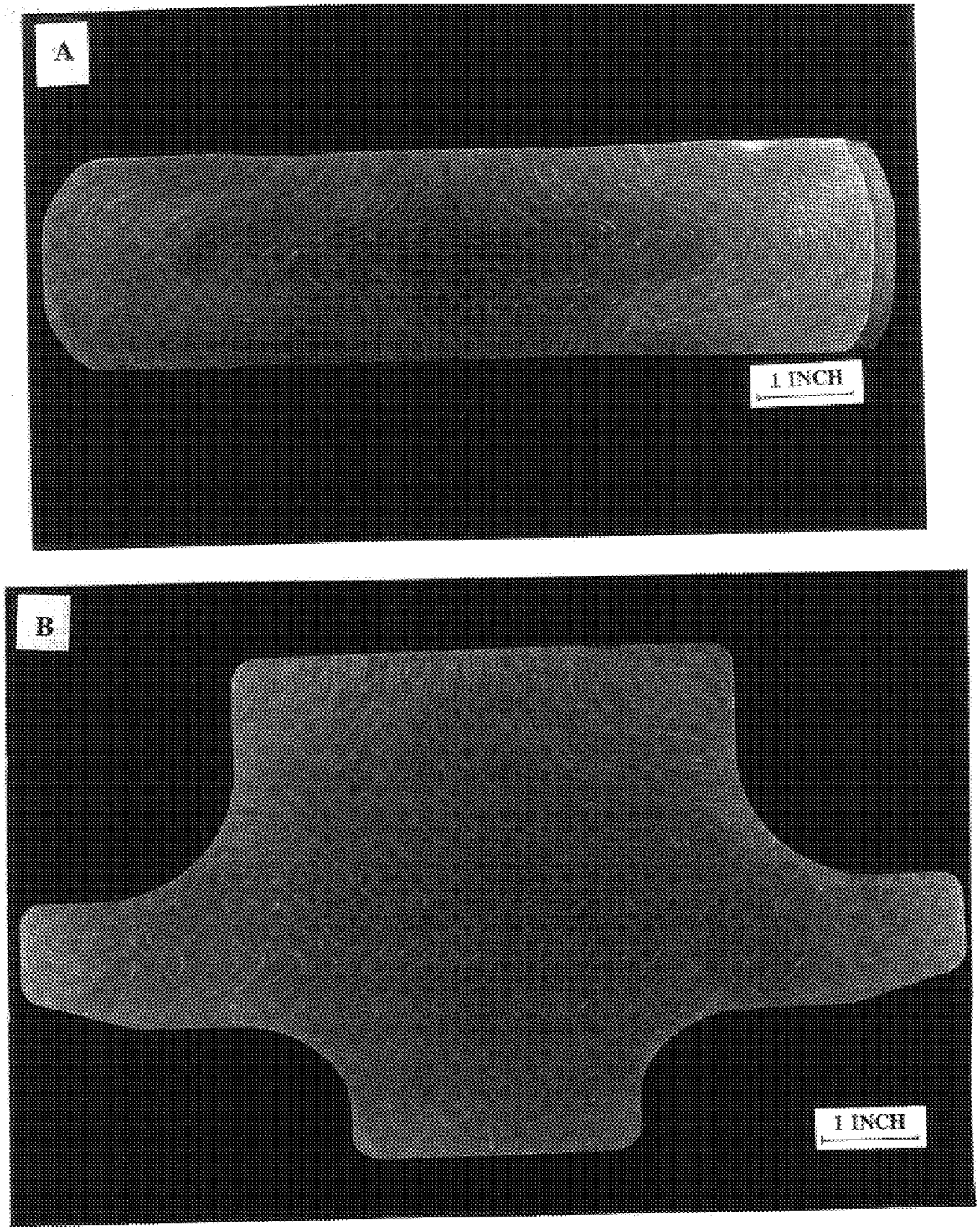
Figure 3: Illustration of articles produced using fine-grain forging method of the present invention: (A) pancake forging (~2.0in. x 9.0in.) and (B) impeller shape machined from forging (~5.5in. x 12.0in.)

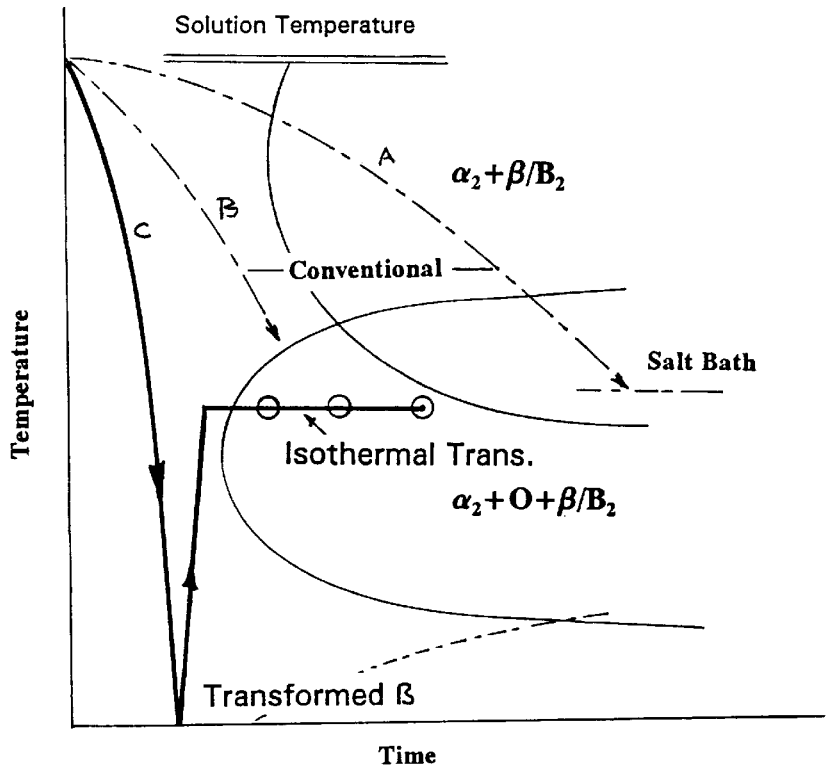
Figure 4: Illustration of cooling methods from solutioning temperature: Conventional cooling rates typically between paths A and B, and fast cooling of present method with no precipitation of $\alpha_2$, path C

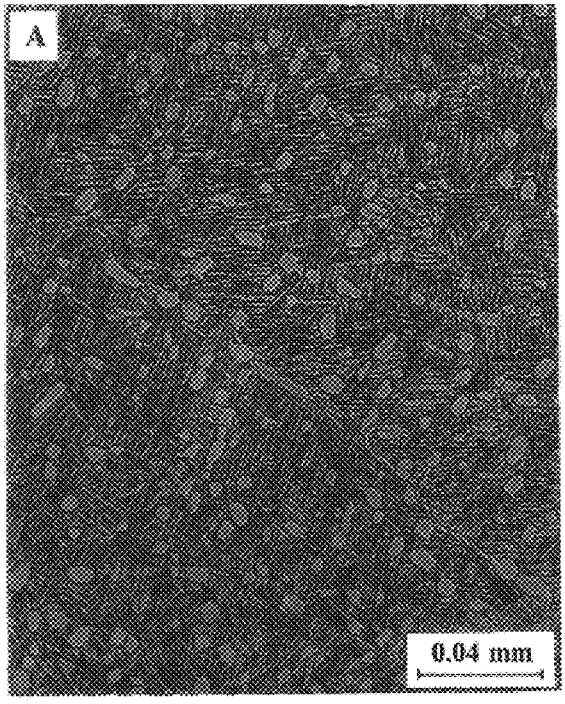

Single $\beta$ or $\beta$ phase + primary $\alpha_2$
➡ Dominantly $\alpha_2$ platelets on conventional cooling + transformed $\beta$ (i.e., $\beta/B_2$)

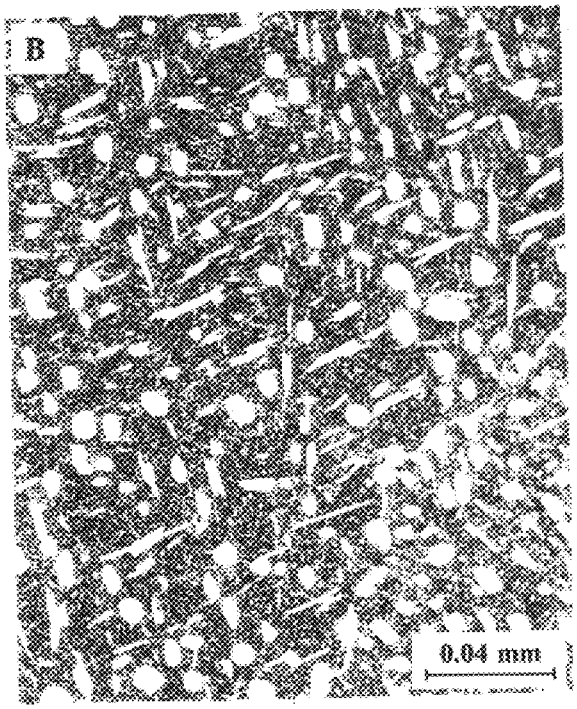

$\beta$ phase + primary $\alpha_2$
➡ Fast cool to transformed $\beta_2$
➡ Transformation Treatment (T,t)
$\beta$ -> O + Fine $\alpha_2$ particles Figure 5: Illustration of microstructure and phase transformation of Super $\alpha_2$: (A) after conventional heat treatment, (B) after heat treatment according to the present invention

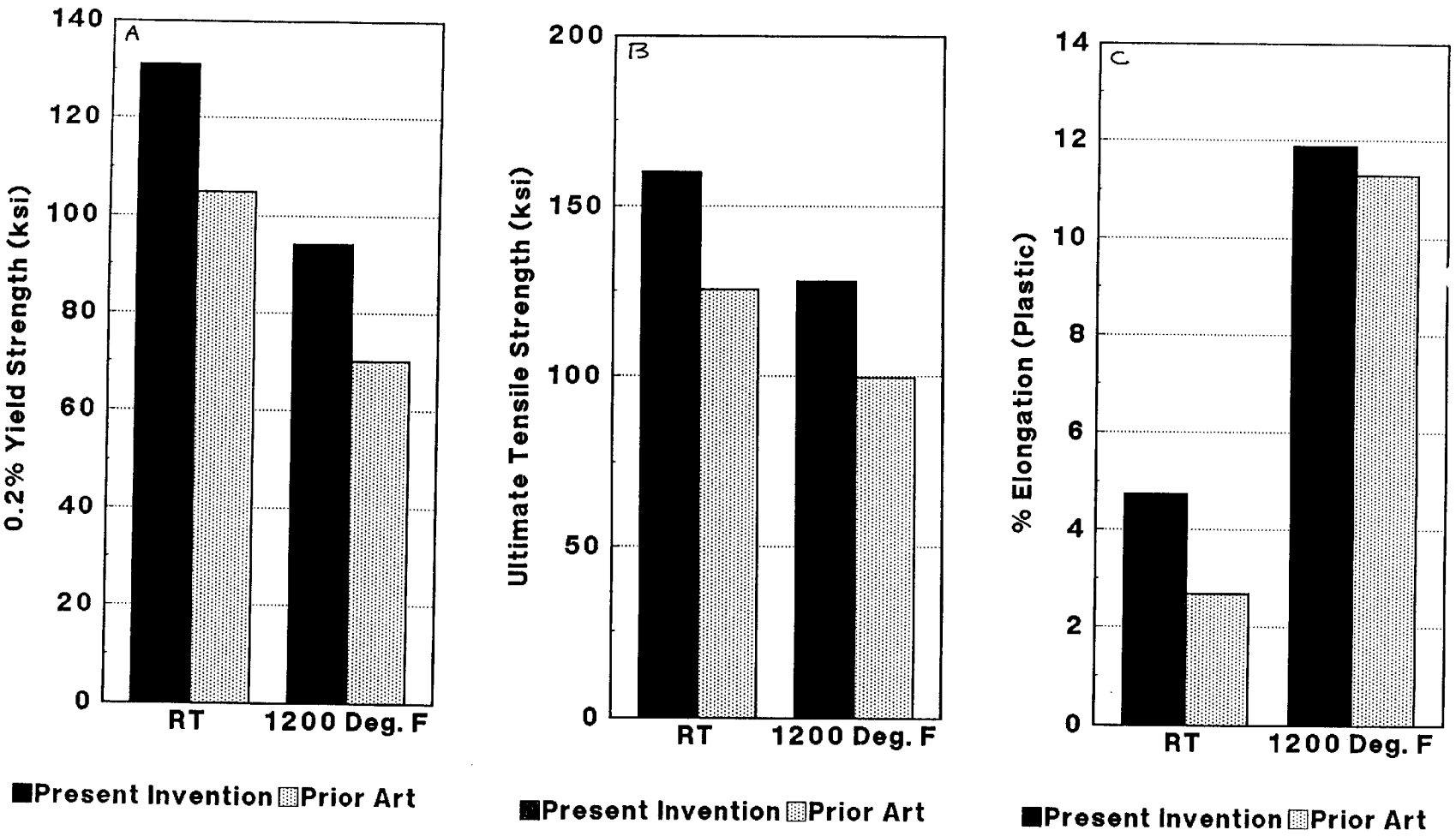
Figure 6: Comparison of room temperature and 1200°F tensile properties of the present invention relative to those of prior art

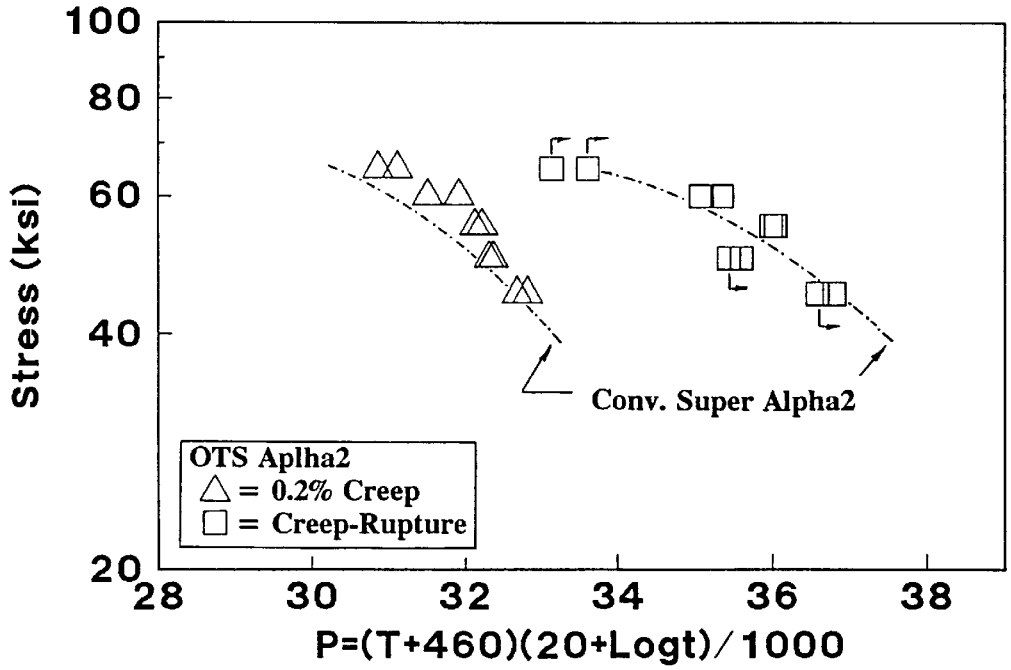
Figure 7: Comparison of creep-rupture (square sysmbols) and 0.2% creep properties (triangle symbols) of the present invention relative to those of prior art (dashed lines)

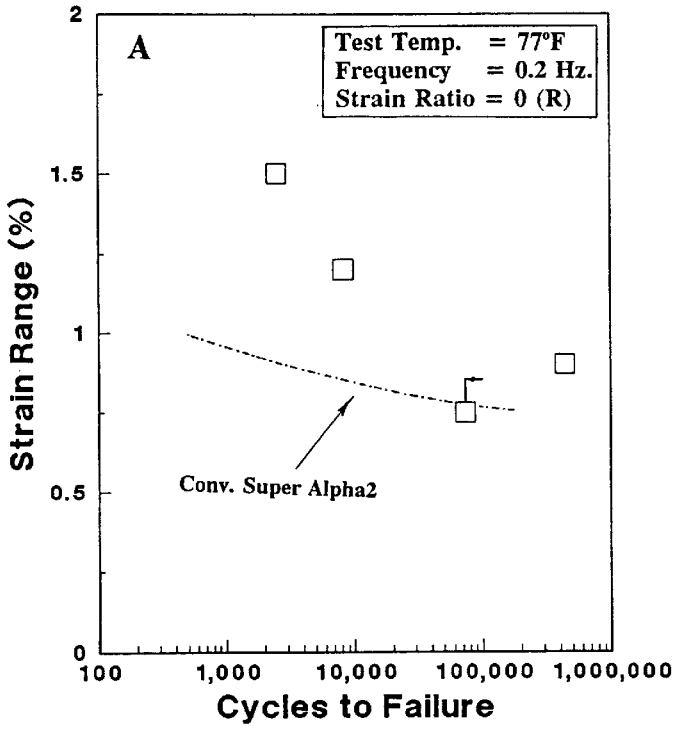
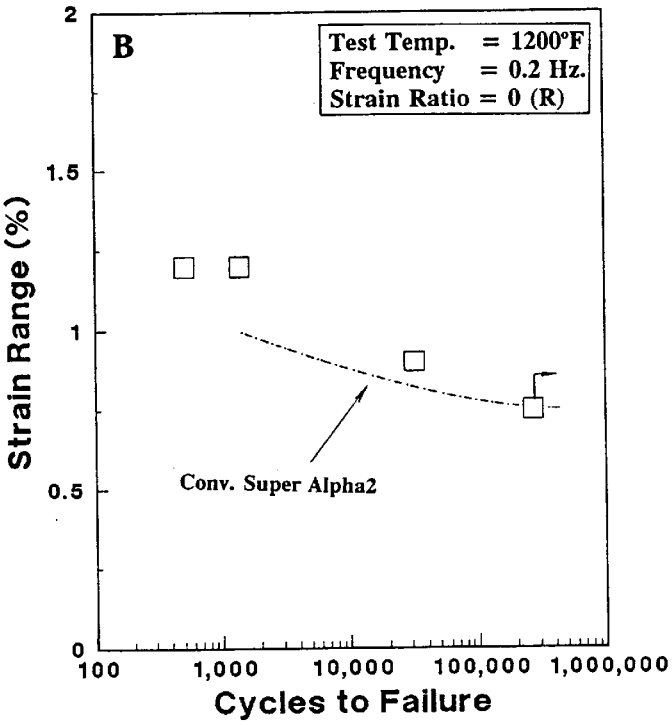
Figure 8: Comparison of room temperature (A) and 1200°F (B) low cycle fatigue (LCF) properties of the present invention (square symbols) relative to those of prior art (dashed lines)

PROCESS FOR PRODUCING FORGED α-2 BASED TITANIUM ALUMINIDES HAVING FINE GRAINED AND ORTHORHOMBIC TRANSFORMED MICROSTRUCTURE AND ARTICLES MADE THEREFROM

This application is a continuation of application Ser. No. 08/362,132 filed Dec. 22, 1994, now abandoned, which is a continuation-in-part of U.S. Ser. No. 08/174,394, filed Dec. 28, 1993 now abandoned.

BACKGROUND OF THE INVENTION

1. Technical Field

The present invention relates to the formation of forged articles from titanium based alloys of the $Ti_3Al$ (Alpha-2) type, and more preferably, $Ti_3Al$ based titanium aluminides containing substantial amounts of beta (β) stabilizers such as $Ti_3Al$+Nb alloys or Super Alpha-2 (Super $\alpha_2$)as disclosed in U.S. Pat. Nos. 4,292,077, 4,716,020, 4,788,035 and 5,032,357 that have good elevated temperature mechanical properties, useful ductility at room temperature, and adequate sensitivity to ultrasonic inspection for detection of material defects. These titanium aluminide alloys have potential for excellent high temperature properties compared to other advanced titanium alloys, such as about 20–30% greater tensile strength at 1200° F. and greater than 100° F. temperature capability useful in gas turbine applications such as impellers and axial rotors.

2. Background Art

Alloys based on $Ti_3Al$ compositions have received considerable attention for their potential use as low density, high strength, high temperature aerospace materials. However, useful application of these alloys as aerospace materials has been prevented, mainly because the alloys which have high temperature mechanical properties, do not have adequate room temperature ductility. Progress was made with $Ti_3Al$+Nb compositions having high β stabilizers (e.g., Nb~10–20%, often with minor additions of Mo, V and Ta) with the purpose of increasing room temperature ductility and fracture toughness. However, property optimization and its consistency in forge-processed alloys has become difficult due to complexity involved in the thermomechanical approaches to process the material.

The titanium aluminide alloys can be forge-processed in several ways. When heated above a temperature called β transus, the material essentially consists of a single phase of β grains, and when cooled below β transus, the alloy exhibits several phases including a dominant alpha-2 ($\alpha_2$) phase due to transformation of the β phase. The $Ti_3Al$ based alloys, as conventionally processed, may be forged above the β transus (β forging) or below the β transus ($\alpha_2$+β forging). Similarly, the material after forging may be heat treated above or below the β transus followed by a stabilization treatment at a lower temperature. For example, see Deluca, D. P. et al: "Fatigue and Fracture of Titanium Aluminides", Report No. WRDC-TR-89-4136, U.S. Air Force, WRDC, February, 1990 and Blackburn and Smith: "R+D on Composition And Processing of Titanium Aluminide Alloys For Turbine Engines", Report No. AFWAL-TR-82-8046, Air Force Systems Command, July 1982, and Blackburn and Smith: "Improved Toughness Alloys Based on Titanium Aluminides", Report No. WRDC-TR89-4095, Air Force Systems Command, October 1989, and Blackburn and Smith U.S. Pat. Nos. 4,716,020 and 4,292,077. One serious problem of the conventionally-processed alloys, as found in the aforementioned references, for example, is the lack of β grain refinement, i.e., the β grains are not recrystallized during forging, and remain very large, for example, in the aforementioned references, the β grain sizes were ~1.2 to 3.0 mm. In U.S. Pat. No. 5,281,285, less than 20% of the beta phase recrystallizes during forging.

While the large grains are acceptable with respect to elevated temperature creep properties, they are not desirable due to reduction in strength and low cycle fatigue (LCF) resistance of the forgings. Also, because of coarse grains, the forged articles made therefrom cannot be inspected efficiently. For example, when detecting internal defects by ultrasonic, non-destructive methods, the presence of large grains create "background noise" or interference which generally requires rejection of the part. The presence of small grains, however, produces sonically-quiet workpieces with minimum interference to sonic testing. In certain titanium alloy applications, such as selected aerospace applications, certain manufacturer's specification dictate that the grain size be less than 0.5 mm and preferably 0.2 mm or less. U.S. Pat. No. 5,026,520 describes a fine grain titanium alloy forging method where it is stated that grain refinement is not achieved dynamically during forging, but requires a static holding time just after forging at the forging temperature to effect static recrystallization of the coarser grains to finer sizes. For $Ti_3Al$ based titanium aluminide alloys, U.S. Pat. No. 4,716,020 indicates that a β grain size 0.15–0.2 mm is desirable but no method of producing such grain size is taught, and the mechanical properties indicated in said Patent are from forgings with β grain size ~1.5 mm×2.5 mm, as disclosed in AFWAL-TR82-4086 at page 20. It is generally recognized in the art of processing titanium or aluminide alloys that further β grain refinement (<0.1 mm) is beneficial for improved strength, ductility, LCF and ultrasonic inspection sensitivity, but no such method of refining the grains in the $Ti_3Al$ based alloys is known to the art.

Several heat treatment approaches are possible for the forged $Ti_3Al$ based alloys. The heat treated alloy can contain a complex microstructure having several phases depending upon the temperature and time of heat treatment. Above the β transus temperature, there is only the body entered cubic phase β. The β transus temperature for Super $\alpha_2$ is about 2010° F. With rapid cooling down from above the β transus temperature, it is possible that no other phase, such as ordered hexagonal $\alpha_2$, will come out and the microstructure will consist of only transformed β phase, or $\beta/B_2$. $B_2$ is a brittle, ordered version of the β phase at lower temperature. In conventional heat treatment, as has been generally employed, the cooling rate is not rapid and the $\alpha_2$ phase comes out as platelets in a matrix of transformed β grains forming what is known as Widmanstatten microstructure.

A typical heat treatment in the conventional processing, e.g., of Super $\alpha_2$ would be solution treatment 25 to 100° F. either above or below the β transus, cooling at an intermediate rate in a salt bath to 1500 to 1600° F. where it is held for some time before cooling to room temperature. The gradual cooling causes the $\alpha_2$ phase to come out as platelets and the formed structure is complex containing some $\beta/B_2$ phases. The material is stabilized at about 1200° F. Typical ductility or % elongation varies from 1.5 to 3.3% at room temperature with the low ductility usually associated with a higher 0.2% yield strength at 1200° F. (e.g., 80–90 ksi) and the high ductility usually associated with a lower 0.2% yield strength at 1200° F. (e.g., 60–70 ksi). The ductility range however is low but is higher than that obtained if the alloy is cooled directly from the solution temperature to room temperature. In direct cooling, with the cooling rate reasonably rapid, the brittle $\beta/B_2$ phase may dominate the structure and room temperature ductility is even lower, possible less than 1%.

The presence of coarse prior β grains in the forge processed material as mentioned earlier, as well as the brittle $\alpha_2$ platelets as the dominant microstructural constituent, as produced by the conventional heat treatment methods, result in an alloy with inadequate room temperature ductility, often low elevated temperature tensile strength and low LCF (low cycle fatigue) life. Furthermore, articles produced are not inspectable by ultrasonic methods due to the coarse β grains. These are important obstacles to the use of $Ti_3Al$+Nb type of forged alloys in gas turbine applications.

Two deficiencies of prior art alloys are: (i) no forge processing method was known to effect dynamic recrystallization of the β grains to finer grains (<0.1 mm), and (ii) microstructural variations other than those dominated by $\alpha_2$ phase were not known in order to produce improved properties. The β phase shows complex phase transformation as a function of temperature and time below the β transus, and in addition to $\alpha_2$ and $\beta/B_2$ phases, existence of an orthorhombic (O) phase has been identified. Several variants of the O phase may be present but no method to generate a stable and beneficial O phase as an important microstructural constituent was known to the art.

The present invention is directed towards resolving these deficiencies, i.e., developing forging method to refine the β grains, and improving the microstructure within the β grains to contain appropriate phases for higher ductility, strength and LCF (low cycle fatigue) resistance from room temperature up to critical use temperature of 1200° F., and to preserving and retaining these properties following extended exposure at or below 1200° F. In addition, by virtue of finer grains, the invention is concerned with improving the sensitivity of ultrasonic inspection to detect small internal defects at levels typically employed in gas turbine titanium alloy rotors.

SUMMARY OF THE INVENTION

We have discovered that the aforementioned improvements in mechanical properties and ultrasonic inspection efficiency of forged $Ti_3Al$ alloys are obtained by a forge processing method that enable >90% refinement of β grains to small size, less than about 0.2 mm and most preferably about 0.02 mm, and alteration of the microstructural constituents within the β grains from those produced by conventional processing.

First, the present forging process enables formation of both small and large forgings, for example, pancake forging (~2.0 in.×9.0 in. diameter) and impeller forging (~5.5 in.× 12.0 in. diameter), with fine recrystallized β grains, having a typical size less than about 0.2 mm and preferably about 0.02 mm, which provides improved properties and enables ultrasonic inspection of forged articles for small internal defects. In conventional forging, coarse β grains are produced and the above benefits are not realized.

Second, the present process preferably includes a heat treatment step in which the forged $Ti_3Al$ based titanium aluminide alloy is cooled directly from its solutioning temperature to room temperature sufficiently rapidly that the β to $\beta/B_2$ transformation occurs with substantially no precipitation of $\alpha_2$ platelets. Thereafter, the alloy is heated to a transformation temperature T for a duration t to form a beneficial O phase microstructure as well as fine $\alpha_2$ particles, and then cooled to room temperature, and the forged and heat-treated alloy is not heated again above the use temperature of 1200° F., whereby the beneficial microstructure is retained and remains stable and beneficial for extended periods of exposure at or below 1200° F.

DESCRIPTION OF THE DRAWINGS

FIG. 1 is a chart comparing of the deformation parameters in the conventional isothermal forging process and the fine-grain forging process of the present invention;

FIG. 2(A) illustrates the β grain size in the microstructure of a conventional forging (Grain size ~0.5 mm×3.0 mm);

FIG. 2(B) illustrates the β grain size in the microstructure of fine-grain forging (Grain size ~0.02 mm) according to the present invention;

FIG. 3(A) illustrates a pancake forging (~2.0 in.×9.0 in.) produced using fine-grain forging method of the present invention;

FIG. 3(B) illustrates an impeller shape machined from forging (~5.5 in.×12.0 in.) produced using fine-grain forging method of the present invention;

FIG. 4 is a time/temperature chart illustrating cooling methods from solutioning temperature: Conventional cooling rates typically between paths A and B, and fast cooling by the present method with no precipitation of $\alpha_2$, followed by transformation heat treatment, shown as path C;

FIG. 5(A) illustrates microstructure and phase transformation after conventional heat treatment of Super $\alpha_2$;

FIG. 5(B) illustrates microstructure and phase transformation after heat treatment of Super $\alpha_2$ according to the present invention;

FIG. 6 illustrates comparative charts of room temperature and 1200° F. tensile properties according to the present invention compared to those of prior art;

FIG. 7 is a comparative stress chart illustrating creep-rupture (shown by square symbols) and 0.2% creep properties (shown by triangle symbols) of the present invention relative to those of prior art (shown by dashed lines);

FIG. 8 is a comparative strain chart illustrating room temperature and 1200° F. low cycle fatigue (LCF) properties of the present invention (shown by square symbols) relative to those of prior art (shown by dashed lines).

DISCUSSION OF THE INVENTION

A preferred embodiment of the present invention relates to producing forged articles of titanium aluminide alloys having (i) a fine β grain size and (ii) microstructure having a orthorhombic crystal structure as an important microstructural constituent within the fine β grains, whereby the presence of a brittle $\alpha_2$ phase and transformed $\beta/B_2$ phases are minimized. Thereafter the microstructure preferably is stabilized in a heat treatment step to produce forged articles having improved mechanical properties and sensitivity to ultrasonic inspection.

The feature of β grain refinement is not achieved by conventional forged processing. The conventional isothermal forging process, as typically conducted, generally encompass true strain values of −0.5 to −1.2 (compressive strain), true strain rates of 0.005 to 0.05 per second, and a temperature range of from 110° F. below the β transus to 100° F. above the β transus. The deformation ranges for conventional forging are illustrated in FIG. 1, showing that it is not possible to refine the large β grains that exist in titanium aluminide billet material which is heated in the furnace at the forging temperature prior to forging. The β grains are coarse, such as 1 to 3 mm, and they are flattened by conventional forging and remain in the structure as illustrated in FIG. 2(A) which is a low magnification optical micrograph (~50×) of conventionally forged Super $\alpha_2$. The micrograph shows flattened β grains of about 0.5 mm (mid-thickness)×3.0 mm (diameter).

In order to refine the coarse β grains through dynamic recrystallization during forging, we have investigated the dynamic recrystallization behavior of Super $\alpha_2$, and found that β grains can be refined only at strain and strain rate conditions that are exceedingly high compared to those that can be achieved in conventional forging equipment, for example, a true strain of −1.6 with strain rates as high as 1 per second showed recrystallization and often in a nonuniform manner. In terms of forging press, however, it meant ~80% reduction and average forging press speeds ~360 inches per minute for 2 inch thick forging and ~825 inches per minute for 5.5 inch thick forging. Commercial presses are limited in actual forging speeds, such as ~150 inches per minute maximum and preferably 100 to 120 inches per minute.

In view of these considerations, the present invention involves maintaining the strain and strain rate ranges in the practical domain of commercial presses, for example, 1.2 to 1.4 true strain, and 0.1 to 0.15 per second strain rate on the high side as illustrated in FIG. 1. To effect recrystallization, we discovered a critical forging temperature below the β transus and in the $\alpha_2$+β two phase field such that a critical distribution of $\alpha_2$ particles is achieved, which together with a "low-friction forging technique" that reduces die and workpiece contact frictions and disperses strain and strain rates uniformly in the billet or workpiece, as described in the U.S. Pat. No. 4,843,856, produces the required uniform grain refinement in the workpiece. We found that the forging temperature must be 75 to 135° F. below the β transus. The β grains are dynamically refined substantially (>90%) throughout the volume of the workpiece to a beneficial grain size (~0.02 mm) which improves properties and ultrasonic inspection efficiency, after which the forging is cooled to room temperature. In the present process, in addition to using the "low-friction forging technique", the strain and strain rate conditions require high % reduction and high speed of the forging press but they are within commercial press limits as indicated in FIG. 1 for forgings up to 5.5 inch section thickness of the workpiece. Examples of forged articles produced in small and large thicknesses, such as 2.0 inch (A) and 5.5 inch (B), are shown in FIG. 3, which illustrate macrostructures through the diametral sections and contain β grains of sizes similar to FIG. 2(B), such as ~0.02 mm.

Microstructural alterations to form a stabilized orthorhombic crystal structure within the fine β grains of the forging required development of a novel heat treatment method. Referring to FIG. 4, the conventional process for cooling titanium aluminide alloys from their solutioning temperature, which could be either above the β transus in the single β phase or below the β transus with predominantly β phase and some primary $\alpha_2$ phase, involves either cooling down continuously (path B) to room temperature over a period of time or indirect cooling (path A) to about 1500 to 1600° F. in a salt bath, at which temperature it is held for some time (e.g., 0.5 to 1 hour), followed by cooling to room temperature. Either method is intended to effect transformation of the β phase: direct cooling produces fine platelike brittle $\alpha_2$ phase in a matrix of transformed p (i.e., $\beta/B_2$), while the indirect cooling and holding at 1500 to 1600° F. in a salt bath causes the $\alpha_2$ phase to come out as coarser platelets in a matrix of transformed β (i.e., $\beta/B_2$) and/or some O phase. The alloy is often stabilized at 1200° F. and then cooled to room temperature. Room temperature ductility (% elongation) varies between about 1.5 and 3.3%. Other properties such as strength, creep and LCF of conventional processing are best exemplified in the reference: Deluca, D. P. et al, "Fatigue and Fracture of Titanium Aluminides", Report No. WRDC-TR-89-4136, U.S. Air Force, WRDC, February, 1990. These properties, being established by a most authoritative and systematic study of Super $\alpha_2$, are used hereinafter to illustrate the advantages of the current invention.

The novel heat treatment method of the present invention involves rapid cooling of the forged alloy and a new transformation treatment. The cooling process is illustrated by curve C in FIG. 4, and involves solutioning the forged alloy below the β transus, e.g., between about 1875° F. and 1935° F., such as at about 1900° F. for Super $\alpha_2$ in the $\alpha_2$+β field where the $\alpha_2$ particles prevent growth of the fine (~0.02 mm) β grains achieved in the forging process, rapidly cooling directly to room temperature to form the transformed β phase (i.e., $\beta/B_2$) with no precipitation of $\alpha_2$ platelets. Thereafter, the transformation treatment involves reheating the forged alloy to a specified temperature T and for a time t to form O phase as well as very fine $\alpha_2$ particles. These are produced as partial transformation products of the β phase. Typical microstructure (B) of the forged product of the phase transformation according to the present process is contrasted with the microstructure (A) resulting from conventional heat treatment, as illustrated by FIG. 5.

The room temperature tensile properties of forged Super $\alpha_2$ transformed partially to orthorhombic crystal structure (O phase), as discussed above, vary significantly depending on the temperature and time of transformation. Table I shows the room temperature tensile properties for transformation temperatures from 1350 to 1600° F. and transformation times of 0.25, 1.0 and 1.5 hours. At lower transformation temperatures (e.g., 1350° F.), very high strengths are achieved, but the ductility is poor. For proper optimization of strength and ductility, in the present invention, the transformation temperature of forged Super $\alpha_2$ has been determined to be a temperature within the range 1525 to 1600° F., and a time within the preferred range 1 to 1.5 hour. Longer time, e.g., up to 24 hours may be used with only slight reduction (~5 to 8%) in strength. With the above selected temperature range, although the 0.2% yield strength and ultimate tensile strength decreased relative to a lower temperature transformation, the room temperature yield strength at about 130 ksi and the ultimate tensile strength at about 160 ksi remained substantially high relative to 95 to 110 ksi yield strength and 115 to 130 ksi ultimate tensile strength values for conventionally processed forged $\alpha_2$ based alloys, including the Super $\alpha_2$ alloy. The % elongation is improved substantially, such as 4 to 6%, making the alloy more ductile at room temperature relative to the conventionally processed Super $\alpha_2$ having typically 1.5 to 3.3% elongation which is unsatisfactory for producing large cross section forging.

TABLE I

Room Temperature Tensile Properties of Fine-Grain Super $\alpha_2$ Forging as a Function of Temperature (T) and Time (t) of the Transformation Treatment

| Transformation Temperature (° F.) | 0.2% Yield Strength (ksi) | Ultimate Tensile Strength (ksi) | % EL | % RA |
|---|---|---|---|---|
| Transformation Time = 0.25 hour | | | | |
| 1350 | 193.5 | 207.3 | 0.5 | 2.0 |
| 1450 | 174.9 | 194.6 | 1.8 | 3.0 |
| 1500 | 176.5 | 195.7 | 2.2 | 4.2 |
| 1550 | 149.9 | 172.8 | 2.8 | 6.1 |
| 1600 | 141.3 | 162.4 | 1.9 | 4.6 |
| Transformation Time = 1 hour | | | | |
| 1350 | 185.1 | 203.7 | 1.0 | 1.7 |
| 1450 | 143.4 | 165.6 | 2.7 | 5.0 |
| 1500 | 160.2 | 180.0 | 1.7 | 4.5 |
| 1550 | 132.9 | 161.5 | 4.8 | 7.3 |
| 1600 | 136.9 | 163.3 | 4.0 | 7.1 |
| Transformation Time = 1.5 hour | | | | |
| 1350 | 182.4 | 196.4 | 0.8 | 2.1 |
| 1450 | 142.4 | 166.5 | 2.8 | 4.5 |
| 1500 | — | — | — | — |
| 1550 | 130.2 | 162.9 | 6.1 | 8.1 |
| 1600 | 129.6 | 158.0 | 5.8 | 8.5 |

While all $\alpha_2$ based titanium aluminides containing more than 12 atomic % β stabilizer are capable of producing an orthorhombic or O phase, the alloy evaluated herein is Super $\alpha_2$ which was selected because it contains Molybdenum (for elevated temperature strength and creep) and it is commercially producible in sizes suitable for forming large forgings, such as impellers and axial rotors. Super $\alpha_2$ in atomic % (at. %) is Ti-25Al-10Nb-3V-1Mo. However, other $\alpha_2$ based titanium aluminide alloys are also capable of forming the O phase and thus are suitable for use according to the present invention. These include, e.g., Ti-(24-26)Al-(17-22)Nb, Ti-15Al-(17-22)Nb, Ti-25Al-10Nb-(2-4)Mo, Ti-(22-24)Al-17Nb-(0.5-1)Mo, Ti-(22-24)Al-17Nb-(1-4)(Cr,W.Cu) and Ti-(23-25)Al-(5-8)Nb-(2-3)(V,Ta,Mo,Cr).

The property values discussed above for Super $\alpha_2$ are further illustrated in the comparative graphs of FIG. 6, which include both room temperature and 1200° F. tensile properties. Graphs A and B illustrate the improvements in ultimate tensile strength and 0.2% yield strength of Super $\alpha_2$ processed according to the present invention relative to the prior art Super $\alpha_2$. The improvement is about 25% or more at both room and elevated temperature. As shown in Graph C, the critical room temperature ductility (% elongation) increases substantially (~2× or more) relative to the prior art.

Thus, the processing method of this invention produces forged Super $\alpha_2$ having substantially improved strength at room temperature and 1200° F., and higher ductility at room temperature due to the formation of the O phase and the β grain size refinement (~0.02 mm). When a forging is made conventionally, where the β grains are large (1.5–2 mm) and a transformation treatment is applied to form the suitable O phase, the room temperature % elongation still improved to about 4% due to the O phase, but the room temperature 0.2% yield strength is lower at about 110 ksi relative to ~130 ksi in the finer grained forging with the same O phase transformation treatment. Thus, the significant property improvements demonstrated herein are achieved by a combination of finer β grains, formed during forging, and formation of a suitable O phase using the temperature and time ranges of the present invention, during the heat treatment step.

For Super $\beta_2$, the beneficial O phase formed in the transformation ranges 1525–1600° F., 1–1.5 hour and then cooled to room temperature, must remain stable for extended exposure to temperatures up to the maximum use temperature of 1200° F. to be of practical value in the manufacturing of articles. This was demonstrated using an approximate 2 inch×9 inch diameter pancake forging processed according to the present invention. Part of the forging was tested without exposure and part following exposure at 1200° F. for 1000 hours. Table II illustrates the effect of exposure on room and elevated temperature tensile properties before and after exposure. As with all titanium alloys which are in high temperature use, there is an initial microstructural stabilization in the present alloy from exposure. The 0.2% yield strength increased and the % elongation decreased slightly at room temperature as is typical of all high temperature titanium alloys. At elevated temperature, e.g., at 1000 and 1200° F., the strength is ~5–8% less in the exposed material but still represents ~20% improvement over the conventionally processed and unexposed Super $\alpha_2$ alloy.

TABLE II

Effect of Exposure on Tensile Properties of Fine-Grain Partial Orthorhombic Transformed Super $\alpha_2$

| Exposure Cond. | Temp. (° F.) | 0.2% Yield Strength (ksi) | Ultimate Tensile Strength (ksi) | % EL | % RA |
|---|---|---|---|---|---|
| Unexposed | RT | 130.0 | 155.1 | 4.0 | 5.1 |
| | 400 | 117.3 | 146.1 | 4.7 | 7.3 |
| | 1000 | 90.3 | 129.1 | 10.9 | 8.9 |
| | 1200 | 89.1 | 116.8 | 9.9 | 9.7 |
| Exposed 1200° F. 1000 hr. | RT | 135.0 | 153.6 | 2.8 | 5.2 |
| | 400 | 110.3 | 143.0 | 6.9 | 9.6 |
| | 1000 | 86.0 | 117.1 | 8.4 | 11.0 |
| | 1200 | 83.1 | 106.8 | 8.6 | 14.3 |

Although the forge processing steps of the present invention produce fine β grain size, i.e., ~0.02 mm versus 1.2–3 mm in conventional forge processing, the 0.2% creep and creep-rupture properties are not compromised because of the alteration in the microstructure. FIG. 7 illustrates that the 0.2% creep life (shown by triangle symbols) and the creep-rupture life (shown by square symbols) of the Super $\alpha_2$ processed according to the present invention is comparable to the conventionally processed Super $\alpha_2$ (dashed lines) which has substantially larger β grain size. Similarly, the fracture toughness of the newly processed material is not compromised, and is typically 15–16 ksi.in$^{1/2}$ which is within the range 12 to 19 ksi.in$^{1/2}$ obtained in conventionally processed Super $\alpha_2$.

Because of the finer β grain size as well as the altered microstructure in the Super $\alpha_2$ forged and heat-treated according to the present invention, significant gain is achieved in the fatigue performance of the alloy. FIG. 8 illustrates the low cycle fatigue life of the Super $\alpha_2$ processed according to the present invention (shown by square symbols) relative to the conventionally processed Super $\alpha_2$ (shown by dashed lines). Test were done under strain controlled fatigue and at room temperature and 1200° F., and the results shown in FIG. 8, Graphs A and B respectively, demonstrate the improved fatigue performance achieved by the present invention.

Also, because of the finer β grain size, the ultrasonic inspection efficiency of the Super $\alpha_2$ processed according to the present invention improved dramatically. For example, a conventionally-processed forging with 1.2–3 mm β grain size cannot be adequately inspected ultrasonically at #2FBH, i.e., at an inspection sensitivity of 0.031 inch, while forgings processed according to the present invention in sizes as large as 5.5 inch in thickness, such as the impeller illustrated in FIG. 3(B), are inspectable to a very high sensitivity such as 50% of #1FBH, i.e., at a sensitivity of 0.008 inch for detection of internal material defects.

Thus, the present invention provides forging methods for producing fine β grain size and heat-treatment methods for alternating the microstructure to form O phase through partial transformation of the $\beta/B_2$ phase within specified temperature and time ranges in Super $\alpha_2$ titanium aluminide, whereby improved tensile strengths, room temperature ductility, low cycle fatigue resistance and ultrasonic inspection efficiency are achieved, without compromising creep and fracture toughness properties relative to conventionally-processed Super $\alpha_2$.

Although the present invention has been shown and described with respect to Super $\alpha_2$, it will be understood by those skilled in the art that various other $\alpha_2$ based alloys, including those with greater than 12 at. % Niobium and which are transformable to an O phase, are within the scope of this invention,.as disclosed hereinbefore.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A forging process for refining the β grain size to improve the mechanical properties and ultrasonic inspection properties of a forging of an alpha-2 titanium aluminide to produce a typical maximum prior β grain size less than about 0.2 mm, comprising the steps of:

(a) heating an alpha-2 titanium alloy billet to a temperature which is 75 to 135° F. below the β transus temperature of said alloy;

(b) forging the heated billet within a true strain range of about 1.2 to 1.4 and within a strain rate of about 0.1 to 0.15 per second, to effect dynamic recrystallization and >90% refinement of prior β grains to a typical size less than about 0.2 mm, and (c) cooling the forged billet to room temperature to produce a forged alpha-2 titanium aluminide alloy having fine grained microstructure, improved mechanical properties and ultrasonic inspection properties and comprising the additional steps of rapidly cooling the forged alloy in step (c) to produce a transformed β phase microstructure with substantially no precipitation of alpha-2 platelets; reheating the cooled alloy to a transition temperature (T) between about 1300° and 1700° F. for a period of time (t) between about 1.0 and 1.5 hours to form orthorhombic phase and fine $\alpha_2$ particles as important microstructural constituents of the forging, and cooling to room temperature to produce an alpha-2 titanium aluminide forging having stable fine grained microstructure, improved mechanical properties and ultrasonic inspection properties.

2. A forging process according to claim 1 in which the transition temperature (T) is between about 1550° and 1600° F.

3. A process for improving the microstructure and mechanical properties of an alpha-2 titanium aluminide forging by formation of an orthorhombic phase and fine $\alpha_2$ particles in the microstructure, comprising the steps of in the following sequence:

(a) heating a forged alpha-2 titanium aluminide to a solutioning temperature which is 75 to 135° F. below the β transus temperature of said alloy;

(b) rapidly cooling the forged alloy to room temperature to produce a transformed β phase microstructure with substantially no precipitation of $\alpha_2$ platelets, (c) reheating the solutioned and cooled forging to a transition temperature (T) between about 1300 and 1700° F. for a period of time (t) between about 1.0 and 1.5 hours to form orthorhombic phase and fine $\alpha_2$ particles as important microstructural constituents, and (d) cooling to room temperature to produce an alpha-2 titanium aluminide forging having stabilized microstructure and improved mechanical properties.

4. A process according to claim 3 in which said alpha-2 titanium aluminide comprises Ti-25Al-10Nb-3V-1Mo.

5. A process according to claim 3 in which the solutioning temperature in step (a) is between about 1875° F. and 1935° F.

6. A process according to claim 3 in which the transition temperature (T) in step (c) is between about 1550° F. and 1600° F.

* * * * *